US006858242B1

(12) United States Patent
Formo

(10) Patent No.: US 6,858,242 B1
(45) Date of Patent: Feb. 22, 2005

(54) DOUBLE BAGGING SYSTEM

(75) Inventor: Norman Paul Formo, Kenmore, WA (US)

(73) Assignee: Formost Packaging Machines, Inc., Woodinville, WA (US)

( * ) Notice: Subject to any disclaimer, the term of this patent is extended or adjusted under 35 U.S.C. 154(b) by 511 days.

(21) Appl. No.: 09/520,947

(22) Filed: Mar. 8, 2000

(51) Int. Cl.[7] ..... B65B 25/18; B65B 53/02

(52) U.S. Cl. ..... 426/410; 426/412; 426/415; 426/122; 426/124; 426/128; 229/87.09

(58) Field of Search ..... 426/124, 410, 426/415, 122, 106, 128, 412, 125, 123; 229/87.09

(56) References Cited

U.S. PATENT DOCUMENTS

| | | | | | |
|---|---|---|---|---|---|
| 2,132,144 | A | * | 10/1938 | Blum | 206/459.5 |
| 2,304,048 | A | | 12/1942 | Jensen | 53/56 |
| 2,320,362 | A | | 6/1943 | Jensen | 53/371.6 |
| 2,366,888 | A | | 1/1945 | Werden et al. | 53/75 |
| 2,367,160 | A | | 1/1945 | Werden et al. | 53/370.6 |
| 2,385,706 | A | | 9/1945 | Jensen | 53/210 |
| 2,391,316 | A | | 12/1945 | Jensen | 198/464.4 |
| 2,676,445 | A | | 4/1954 | Kottmann | 53/371.7 |
| 2,676,692 | A | | 4/1954 | Bauer | 198/468.6 |
| 2,691,856 | A | | 10/1954 | Jensen et al. | 53/133.7 |
| 2,697,474 | A | | 12/1954 | McGinley | 53/371.3 |
| 2,736,421 | A | | 2/1956 | Bell | 198/803.11 |
| 2,747,349 | A | | 5/1956 | Kottmann | 53/210 |
| 2,817,933 | A | | 12/1957 | Bell et al. | 53/52 |
| 2,844,242 | A | | 7/1958 | Panuline | 198/626.5 |
| 2,848,224 | A | | 8/1958 | Jensen | 226/33 |
| 2,860,469 | A | | 11/1958 | Bell | 53/372.4 |
| 2,887,212 | A | | 5/1959 | Waite | 198/731 |
| 2,926,472 | A | | 3/1960 | Waite | 53/203 |
| 3,092,502 | A | * | 6/1963 | Smith | 426/87 |
| 3,132,028 | A | * | 5/1964 | Austin et al. | 53/449 |
| 3,428,240 | A | * | 2/1969 | Morris | 229/87.09 |
| 3,504,784 | A | | 4/1970 | Noyes | 198/732 |
| 3,508,379 | A | | 4/1970 | Noyes et al. | 53/572 |
| 3,527,337 | A | | 9/1970 | Formo | 198/732 |
| 3,590,553 | A | | 7/1971 | Formo | 53/69 |
| 3,868,807 | A | | 3/1975 | Noyes et al. | 53/459 |
| 3,914,917 | A | * | 10/1975 | Young | 53/434 |
| 3,930,352 | A | | 1/1976 | Carnes | 53/572 |
| 5,741,075 | A | * | 4/1998 | Collins et al. | 383/5 |

FOREIGN PATENT DOCUMENTS

| | | | | | |
|---|---|---|---|---|---|
| AU | 9344229 | A | * | 2/1994 | B65D/33/16 |
| AU | 9642135 | A | * | 8/1996 | B65B/25/18 |
| GB | 1152281 | | * | 5/1969 | B65D/85/36 |
| GB | 2331059 | A | * | 5/1999 | B65B/25/00 |
| GB | 2350103 | A | * | 11/2000 | B65D/33/16 |
| NZ | 243745 | A | * | 8/1996 | |
| NZ | 270385 | A | * | 8/1998 | |

* cited by examiner

*Primary Examiner*—Milton I. Cano
*Assistant Examiner*—Robert Madsen
(74) *Attorney, Agent, or Firm*—Christensen O'Connor Johnson Kindness PLLC

(57) ABSTRACT

High end or premium bread, including presliced loaves, are inserted into a preformed inner bag by an automatic bagging machine. The open end of the inner bag is gathered and sealed, and thereafter the inner bag is heat shrunk to closely enclose a loaf. Then the heat shrunk inner bag and enclosed loaf is bagged by a second automatic bagger, and the outer bag is then closed by an automatic bag closer. The inner bag preferably has a gusseted closed end which is adjacent to the openable end of the outer bag for presentation to a consumer. Such closed end of the inner bag can have bag weakening perforations or scores for convenient opening by the consumer.

11 Claims, 4 Drawing Sheets

DOUBLE BAGGING SYSTEM

FIELD OF THE INVENTION

The present invention relates to a system for packaging articles, particularly loaves of bread and, more particularly, "high end" or premium breads which heretofore have been first wrapped by an automatic wrapping machine and thereafter bagged by an automatic bagging machine.

BACKGROUND OF THE INVENTION

Automatic wrapping machines for bread have been known for a long time. An example is a wrapping machine of the general type described in Jensen et al. U.S. Pat. No. 2,691,856, assigned to American Machine & Foundry Co. ("AMF") and the patents referred to therein and other patents of AMF. In such a machine, an individual loaf to be wrapped is moved transversely of its length against a draped or depending leading or free end of a continuous wrapper web as the loaf travels from an infeed conveyor. The web is fed from a roll. In early machines, the wrapping material web consisted of waxed paper, whereas later machines were converted to use cellophane and, still later, polypropylene. The wrapping sequence is essentially the same regardless of the wrap material used. Typically, the wrapper web material is drawn over the top of the loaf and down along the rear side under a desired amount of tension. The loaf and wrapper web are manipulated to form a lap joint on the underside. The web then is cut and the loaf delivered to a heated platen for heat sealing the lap joint. The ends of the wrap are tucked or folded and sealed to complete the wrap.

As compared to the older wrapping equipment, more modern automatic bagging machines use stacks of preformed bags stored on wickets. An individual bag is opened to receive a loaf fed lengthwise into the bag, and the bag can be closed by a twist tie or clip.

The more modern bagging machines are of less complicated construction and more reliable than the older wrapping machines. Also, there is less likelihood that the bag will come open during shipping and handling, i.e., before taken home by the customer. The bagging machines also are adaptable to different articles. Consequently, automatic bagging machines continue to be sold and improved, whereas new wrapping machines have not been sold for quite some time.

For "high end" or "premium" breads, it has become common to use the older wrapping machines to form an inner wrap for a tighter, neater and more consistently shaped package which then is bagged by an automatic bagging machine. Still, the older wrapping machines have the undesirable characteristics of being complicated and less reliable, and parts have become scarce and expensive. Further, the inner wrap may loosen so that a customer opening the outer bag may suspect tampering or an inadequate inner wrap.

SUMMARY OF THE INVENTION

The preferred embodiment of the present invention provides a system for a double package for high end or premium bread, including pre-sliced loaves, having a tight, neat inner package and an outer bag. The inner package preferably is formed by a bagging operation using modern bagging equipment, as compared to the known inner wrapped package. In the present invention, this can be achieved by initially bagging the bread in a preformed bag which then has its open end gathered and heat sealed. Thereafter the sealed bag is heat shrunk, but only to the degree necessary to create a reasonably tight, neat package. Preferably the closed end of the heat shrinkable bag is gusseted for an attractive appearance. Thereafter, the bagged product is fed to an automatic bagging machine to apply a looser outer bag and, from there, to an automatic bag closer such as a twist tie or clip applying machine.

In another aspect of the present invention, the closed end of the inner bag has perforations for easy opening by the customer and also to provide a tamper evident package.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
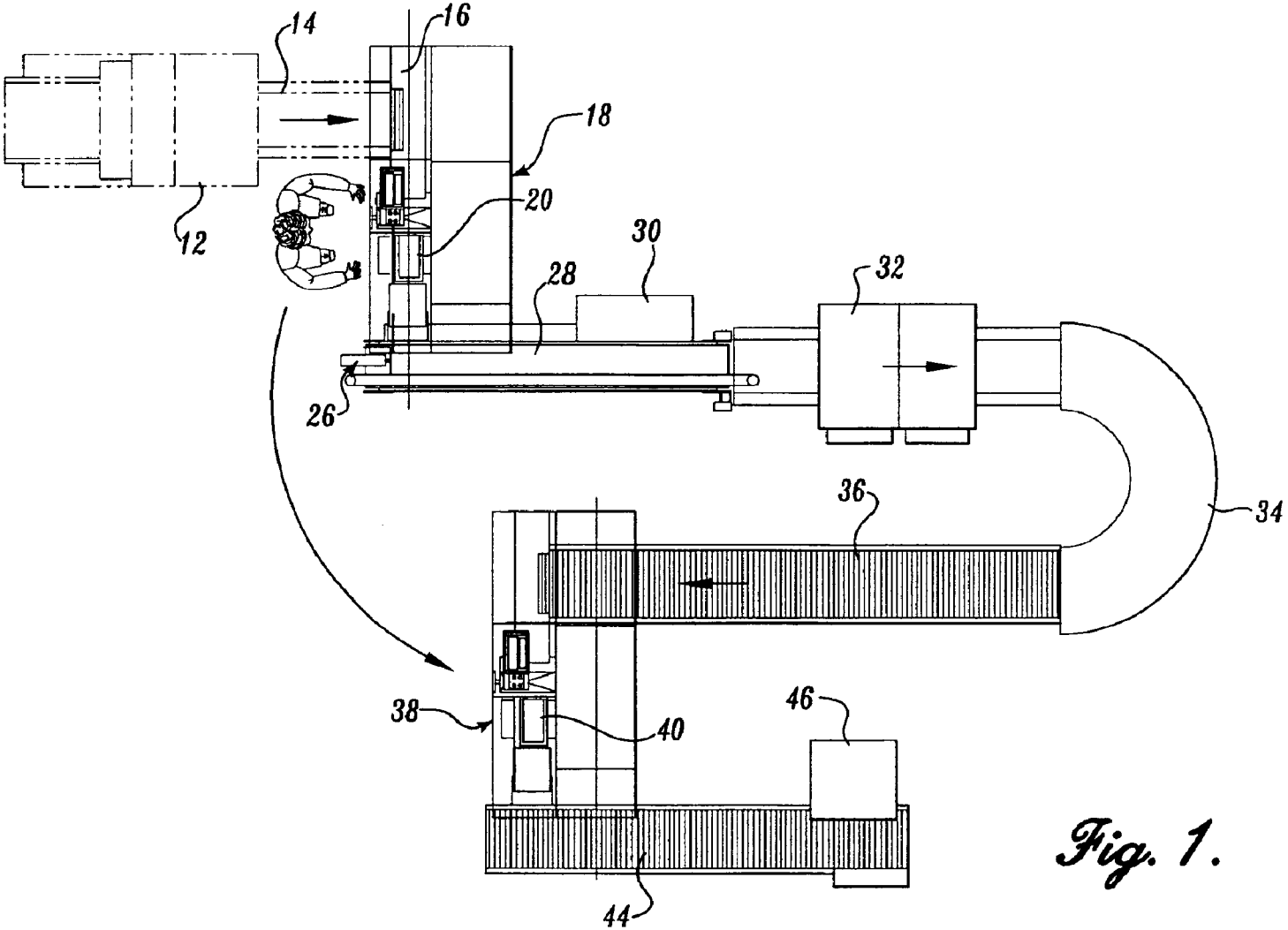
FIG. 1 is a diagrammatic top plan of apparatus used in a preferred embodiment of a double bagging system in accordance with the present invention.

The present invention can be practiced using largely conventional components to achieve a novel and unobvious result. In general, the preferred embodiment of the invention pertains to automatic packaging of loaves of bread, particularly "high end" or "premium" breads. An example of a layout of the components is shown in FIG. 1.

Figure 2A:
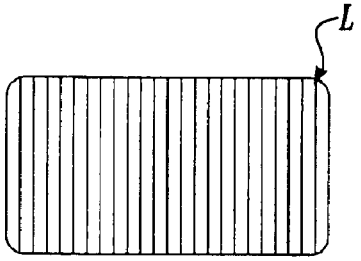
FIGS. 2A–2F illustrate sequential steps in the double bagging of a loaf of bread in accordance with the system of the present invention.

First, loaves of bread to be packaged are fed to a slicing machine 12. An example of such a slicing machine is the model 9075 slicer available from United Bakery Equipment (UBE) of Compton, Calif. At this stage, the sliced bread loaf L can be diagrammatically illustrated as shown in FIG. 2A, but it should be noted that individual loaves will vary somewhat in length, height, and profile.

The sliced loaf is transported by an exit conveyor 14 to the transfer mechanism 16 of an automatic bagging machine 18, such as a model JV60 or GT4 horizontal bagger available from Formost Packaging Machines, Inc., of Woodinville, Wash. Such a horizontal bagger has a stack of preformed, wicketed bags 20 which are filled consecutively in conjunction with the automatic bag opening and product inserting mechanism.

Figure 2B:
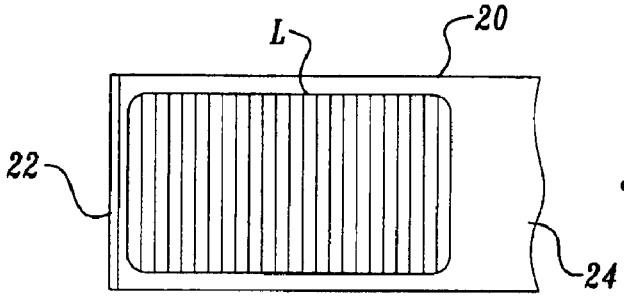

At this stage, the product can be represented as illustrated in FIG. 2B. The loaf L is contained within a preformed bag 20 having a closed end 22 and an open end 24. Returning to FIG. 1, the bagged product is fed closed end first to an automatic product pusher 26 (an option of the Formost JV60 and GT4) which feeds the bagged product to the conveyor 28 of a bag sealing head 30.

Figure 2C:
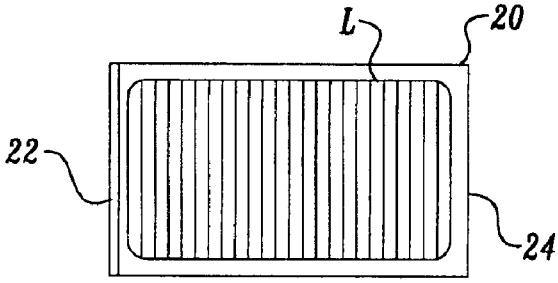

In a representative embodiment, the bag sealing head includes mechanism for gathering the open end of the bag, and to seal and trim the newly closed end of the bag. A representative sealing head is the model HCBS available from All Packaging Machinery (APM) of Ronkonkona, N.Y. At this stage, the bagged product can be represented as shown in FIG. 2C, in which the loaf L is somewhat loosely enclosed within the bag 20 having the preformed end 22 and the newly closed, sealed and trimmed end 24.

Figure 2D:
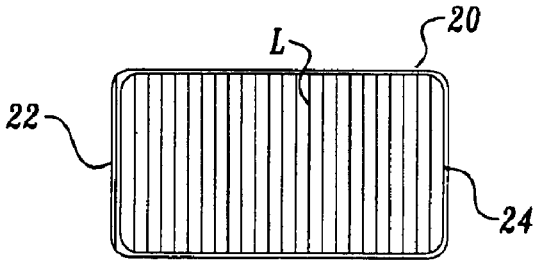

Next, the loosely bagged product is conveyed through a shrink tunnel 32, such as the model 7141 available from Weldotron Company of Piscotaway, N.J., or the model T-62 available from Shaklin Company of Ayer, Mass. As described in more detail below, heat shrinks the bag to a fairly tight condition as represented in FIG. 2D. The relative sizes of the bread loaf L, bag 20, and the characteristics of the inner bag material are selected to achieve the desired fit. At this stage the preformed closed end 22 of the bag will retain a neater appearance than the gathered and sealed end of the bag 24.

Figure 2E:
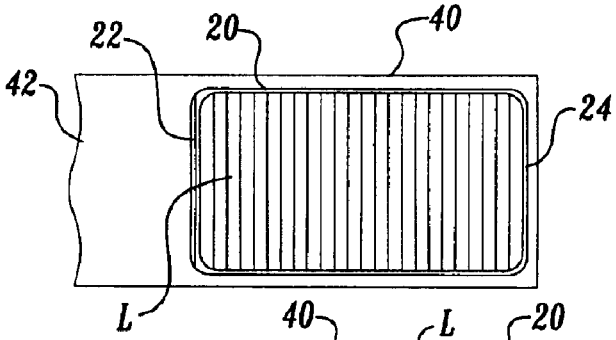

From the shrink tunnel 32, the loaf is fed to a 180° turn conveyor 34 onto another infeed conveyor 36 which can, for example, be a driven free roller conveyor. Turning the bagged product results in the newly-formed end being presented first to a second automatic bagging machine 38 such as a Model JV60 or GT4 Formost horizontal bagger. Such horizontal bagger has a stack of preformed bags 40 which are filled consecutively by the incoming inner bagged loaves, i.e., bagger 38 runs on demand. The heat shrunk inner bag and enclosed loaf are inserted through the open end of the outer bag, by movement of the loaf or the outer bag, depending on the particular bagger used. At the exit end of the bagger 38, the now double-bagged product can be represented as shown in FIG. 2E, with the outer bag 40 being open at its end 42. This is the end that will normally be opened first by the consumer, which would reveal the neat appearing preformed end 22 of the inner bag 20.

Figure 2F:
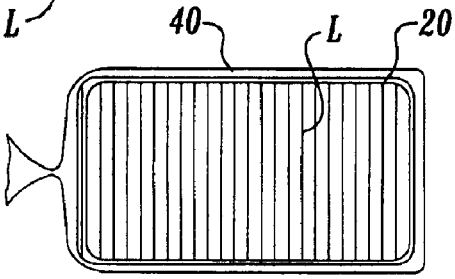

Finally, an exit conveyor 44 conveys the double-bagged product to automatic closing equipment 46 for the outer bag, such as a twist tier (such as a model 2000 or 2100 available from Burford Company of Maysville, Okla.), or clip applying machine (such as the model 872B available from Kwik Lok Company of Yakima, Wash.), or other conventional bag closing apparatus, resulting in the double bagged condition of FIG. 2F.

Figure 3:
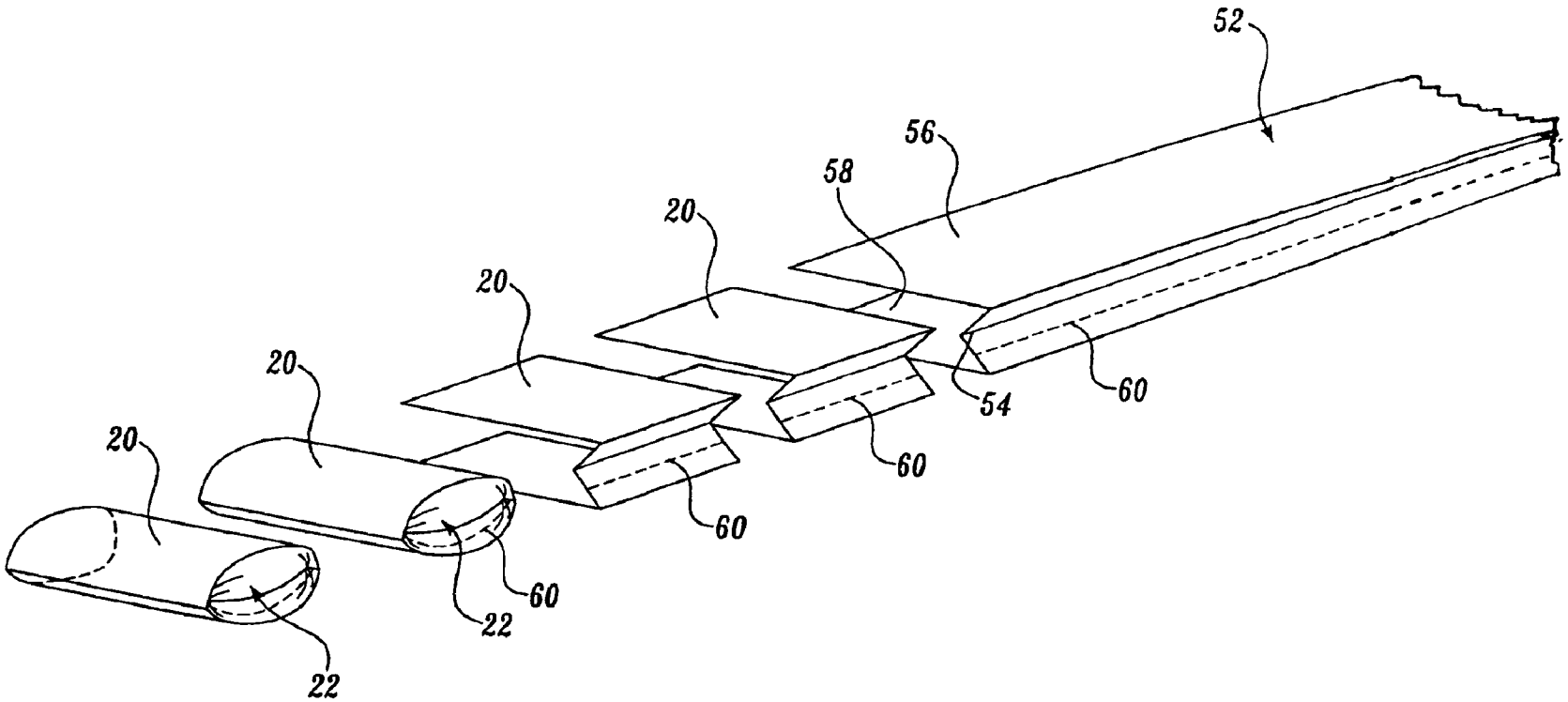
FIG. 3 is a diagrammatic perspective illustrating formation of an inner bag that can be used in the system of the present invention.

As emphasized above, a neat appearing inner bag is considered to be important. FIG. 3 illustrates diagrammatically formation of the inner bags. Bag web material 52 from a roll is formed with a single accordion fold or gusset 54. More specifically, the continuous bag web is formed with a with a top sheet 56 and a bottom sheet 58 joined by the V-fold 54 along one side of the web. Individual bag blanks 20 are cut from the leading end of the web and have their sides sealed and trimmed conventionally as represented at the lower left of FIG. 3. The free edge of the bottom sheet 58 typically would project beyond the free edge of the top sheet 56, with holes punched in the projecting portion or margin of the bottom sheet for wicketing. Thereafter the individual bags are stacked and wicketed at the first bagging machine 18. The gusset provides for the neater appearance at the closed end 22 of the bag.

In addition, the closed end 22 of each bag 20 can be formed with a horizontal row of perforations 60 which will be in the end of the inner bag presented to the consumer when the outer bag is opened. Such perforations can be formed in a continuous row along the gusseted portion of the bag web material as illustrated in FIG. 3. Alternatively, a shorter row of perforations can be provided, spaced uniformly along the length of the bag web so as to be approximately centered in the gusseted end of each finished bag.

Figures 4A, 4B, 4C, 4D, 4E, 4F, 4G, 4H, 4I, 4J, 4K, 4L, 5:
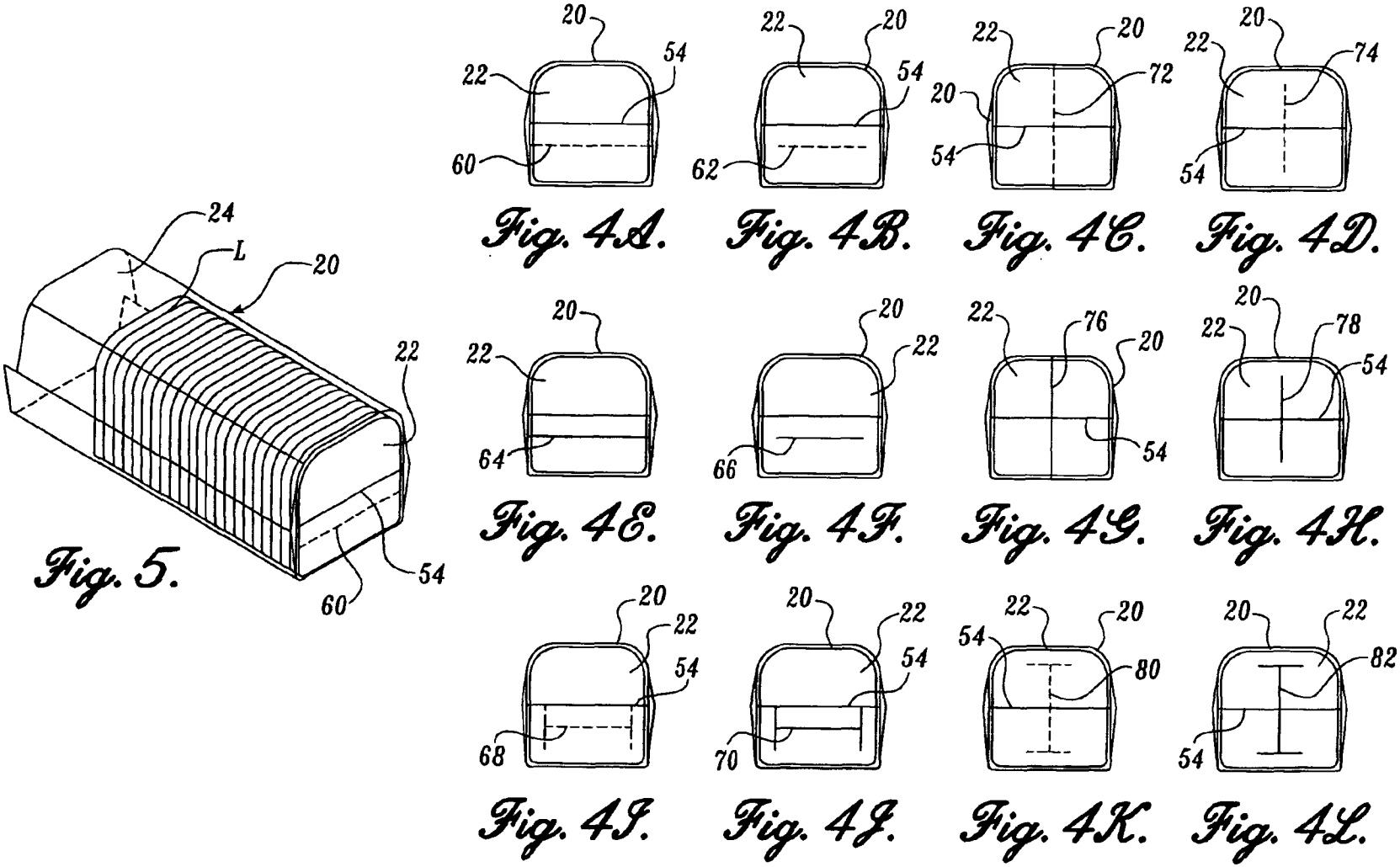
FIGS. 4A–4L illustrate closed ends of bags formed in accordance with FIG. 3 having different arrangements of tamper evident perforations or scores in the closed ends thereof.
FIG. 5 is a top rear perspective of a product after bagging in an inner bag of the type shown in FIG. 4B.

More specifically, the bag end 22 can appear as shown in FIG. 4A and FIG. 5 with a continuous row of perforations 60 extending horizontally from side to side, or a shorter row of perforations 62, as seen in FIG. 4B. Rather than perforations, the bag web material can have a continuous bag-weakening score 64, as shown in FIG. 4E, or a shorter horizontal score 66 as shown in FIG. 4F. Other arrangements of equivalent bag opening means can be provided, such as the "H" arrangement of perforations 68 shown in FIG. 4I or the "H" configuration of bag weakening scores 70 shown in FIG. 4J. While it is preferred that the primary bag-weakening and opening means extend horizontally, it also could extend vertically as shown in FIGS. 4C (continuous perforations 72 along the closed end 22 of the bag 20), 4D (shorter column of perforations 74), 4G (continuous vertical score 76), 4H (shorter vertical score 78), 4K (sideways "H" configuration of perforations 80), and 4L (sideways "H" scoring 82). Horizontal perforations or scoring is preferred because it extends in the machine direction (bag web direction) during formation of the inner bag. In any event, the bag opening means allows the inner bag to be opened conveniently by the consumer without having to remove the inner bag from the outer bag, for convenient dispensing of the product. The bag opening means also has the advantage of providing a tamper evident package.

Conventional materials deliberately designed for heat shrinking may stretch unduly, or be too weak for achieving the tight, neat package desired, or shrink too tightly and deform some or all of the loaves. In the currently preferred embodiment, the preferred material for the inner bag is a low density polyethylene (PE) with or without ethyl vinyl acetate (EVA) additive, but another possibility is a polyolefin bag. The material and characteristics of the shrink tunnel must be selected with the intended use in mind. For example, typically the sliced bread would be delivered at a temperature between about 95° and 115° F. and it is preferred that additional heat supplied during the inner bagging and bag shrinking operation not be excessive. In the currently preferred embodiment, the PE inner bag is shrunk in a shrink tunnel approximately 93 inches long at a temperature of about 400° F. for a period of about 3 to 4 seconds, but even these characteristics are dependent on the looseness of the fit of the loaf in the unshrunk bags 20. For example, in the currently preferred embodiment the circumference of the bag exceeds the circumference of the loaf by about 1 inch to 2 inches prior to shrinkage, which has been found to accommodate expected variations in the incoming bread loaf size and still achieve a reasonably tight, neat fit for the inner bag. After shrinkage of the inner bag it is preferred that the circumference of the bag exceed the circumference of the loaf by no more than about one-quarter inch to one-half inch. A looser fit initially will mandate a greater degree of shrinkage to achieve an equivalent inner package.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method for packaging a loaf of bread, which method comprises:

feeding the loaf through an open first end of an inner preformed bag having a closed second end opposite the first end, the closed second end of the inner preformed bag having bag-weakening opening means for enabling access to the loaf by a consumer through the second end of the inner bag;

closing the first end of the inner bag and heat shrinking the inner bag to closely encircle the loaf;

inserting the heat shrunk inner bag and enclosed loaf endwise, second end last, through an open end of a preformed outer bag which outer bag has a closed end opposite the open end, the open end of the outer bag being configured for closing and for reopening by a consumer, but the closed end of the outer bag not being configured for opening by a consumer; and closing the open end of the outer bag such that the bag-weakening opening means is presented to a consumer upon reopening of the open end of the outer bag, without providing bag-weakening opening means in the closed end of the outer bag and without exposing the first end of the inner preformed bag at the reopened end of the outer bag.

2. The method defined in claim 1, in which the bag-weakening opening means includes a row of bag-weakening perforations in the second end of the inner bag for manual opening of the inner bag by a consumer after reopening of the open end of the outer bag.

3. The method defined in claim 1, in which the bag-weakening opening means includes a horizontal row of bag-weakening perforations in the second end of the inner bag for manual opening of the inner bag by a consumer after reopening of the open end of the outer bag.

4. The method defined in claim 1, in which the bag-weakening opening means includes a bag-weakening score in the second end of the inner bag for manual opening of the inner bag by a consumer after reopening of the open end of the outer bag.

5. The method defined in claim 1, in which the bag-weakening opening means includes a horizontal bag-weakening score in the second end of the inner bag for manual opening of the inner bag by a consumer after reopening of the open end of the outer bag.

6. The method defined in claim 1, performing the method automatically, including feeding the loaf through an open first end of an inner preformed bag having a closed second end opposite the first end by a first automatic bagging machine, and inserting the heat shrunk inner bag and enclosed loaf through an open end of a preformed outer bag by a second automatic bagging machine, such inserting by the second bagging machine being performed by moving the heat shrunk inner bag and enclosed loaf endwise, second end last, through the open end of the preformed outer bag.

7. The method defined in claim 6, including automatically transferring the loaf enclosed in the inner bag from the first automatic bagging machine to the second automatic bagging machine and orienting the loaf for presentation to the second automatic bagging machine for insertion endwise, second end last, into the outer bag at the second automatic bagging machine.

8. A packaged product comprising a loaf of bread snugly enclosed in an inner heat shrunk bag having a preformed closed end and a gathered, previously open end opposite the preformed closed end, such heat shrunk inner bag and enclosed loaf being contained within a separate outer bag having a closed first end and an openable second end, the preformed closed end of the heat shrunk inner bag being adjacent to the openable end of the outer bag and such closed end of the heat shrunk inner bag having bag-weakening means for manual opening of the inner bag by a consumer, the second end of the outer bag being configured for opening by a consumer but the closed first end of the outer bag not being configured for opening by a consumer, and the inner bag being disposed within the outer bag with the preformed closed end of the inner bag adjacent to the openable second end of the outer bag and the gathered end of the inner bag remote from the openable second end of the outer bag.

9. The packaged product defined in claim 8, in which the preformed closed end of the inner bag is gussetted.

10. The packaged product defined in claim 8, in which the preformed closed end of the inner bag has perforations for opening of the inner bag.

11. The packaged product defined in claim 8, in which the closed end of the inner bag has a bag-weakening score for manual opening of the inner bag.

* * * * *

UNITED STATES PATENT AND TRADEMARK OFFICE

CERTIFICATE OF CORRECTION

PATENT NO. : 6,858,242 B1
DATED : February 22, 2005
INVENTOR(S) : N. P. Formo

It is certified that error appears in the above-identified patent and that said Letters Patent is hereby corrected as shown below:

Column 5,
Line 39, "claim 1, performing" should read -- claim 1, including performing --

Signed and Sealed this

Fifth Day of July, 2005

JON W. DUDAS
*Director of the United States Patent and Trademark Office*